United States Patent [19]

Duffner et al.

[11] 3,949,248

[45] Apr. 6, 1976

[54] PIEZOELECTRIC IGNITER USING RESILIENT HOUSING

[75] Inventors: Konrad Duffner, Nurnberg; Horst Schäfer, Friedrichsdorf, both of Germany

[73] Assignee: Braun Aktiengesellschaft, Frankfurt am Main, Germany

[22] Filed: July 8, 1974

[21] Appl. No.: 486,627

[30] Foreign Application Priority Data

July 10, 1973 Germany ..... 2335058

[52] U.S. Cl. ..... 310/8.7; 310/9.1; 317/DIG. 11

[51] Int. Cl.[2] ..... H01L 41/04

[58] Field of Search ..... 310/8.3, 8.7, 9.1, 9.4; 317/DIG. 11, 79

[56] References Cited

UNITED STATES PATENTS

| | | | |
|---|---|---|---|
| 3,082,333 | 3/1963 | Hufferd et al. | 310/8.3 |
| 3,457,461 | 7/1969 | Steinke et al. | 317/DIG. 11 |
| 3,486,075 | 12/1969 | Steinke et al. | 317/DIG. 11 |
| 3,509,388 | 4/1970 | Mifune et al. | 310/8.7 |
| 3,729,639 | 4/1973 | Heinouchi et al. | 310/8.7 X |
| 3,741,714 | 6/1973 | Yoshinaga | 310/8.7 X |
| 3,866,069 | 2/1975 | Ishii et al. | 310/8.7 |

*Primary Examiner*—Mark O. Budd

*Attorney, Agent, or Firm*—Frederick E. Bartholy

[57] ABSTRACT

A piezoelectric igniter which has a piezoelectric transducer for converting mechanical into electrical energy. Said transducer is housed at the bottom of a housing of plastics material, which housing is resilient in the axial direction. The transducer cooperates with a hammer which is movable towards the transducer and is actuated by an energy storing spring, which may be compressed and torsioned by pressing on an actuating cap and which comprises a laterally protruding locking pin, co-operating with L-shaped recesses in the housing and with apertures in the actuating cap having a slant cam surface. The resiliency of the plastics housing leads to a greater efficiency of the igniter.

1 Claim, 3 Drawing Figures

PIEZOELECTRIC IGNITER USING RESILIENT HOUSING

BACKGROUND OF THE INVENTION

In a known construction of a piezoelectric igniter, a piezoelectric transducer is accomodated in a housing, open at one end and guiding a hammer which is movable towards the transducer and which co-operates with an energy storing spring, which may be compressed and torsioned under the influence of an actuating cap and which comprises a laterally protruding locking pin, engaging in L-shaped recesses of the housing and traversing apertures of the actuating cap which are respectively provided with a slant cam surface.

Such a known piezoelectric igniter allows a sudden release of the energy storing spring which accelerates the hammer and causes the same to impinge on the piezoelectric transducer with a definite speed. The housing and the actuating cap of such a known igniter are manufactured from stamped sheet metal parts. Such an igniter has a poor lifetime and a low conversion efficiency of converting mechanical into electrical energy.

BRIEF SUMMARY OF THE INVENTION

It is an object of the invention to provide a piezoelectric igniter which has a longer life and provides a higher spark energy at a given volume of the housing.

The solution of this problem is to be seen in that the housing consists of a plastics material and is designed to be resilient in the axial direction. Surprisingly is has been found that by this means the spark energy is increased by 15 to 20 percent in comparison to known piezoelectric igniters having a metal housing. Moreover, the locking pin slides on plastics material, and the wear is reduced accordingly.

Preferably, the actuating cap consists of plastics material, too. Thus it can be achieved that the actuating cap slides on the wall of the housing with a relatively small clearance. Therefore, no additional guide means for the actuating cap will be necessary.

Resiliency of the housing may be achieved by shaping the bottom of the same convex to the inside of the housing.

Resiliency may also be achieved by arranging a resilient electrode plate between the piezoelectric transducer and the bottom of the housing.

A particularly advantageous embodiment, which allows a simple assembly of the igniter has a housing which comprises near the bottom of the same a lateral aperture in the side wall of the housing adapted for inserting a piezoelectric transducer, and further comprises holding tabs mounted in the lower region of the aperture.

The invention will further be described hereinafter in a preferred embodiment with reference to diagrammatic drawings, which embodiment in no way is restrictive to the scope of the invention.

DETAILED DESCRIPTION OF PREFERRED EMBODIMENTS

Figure 1:
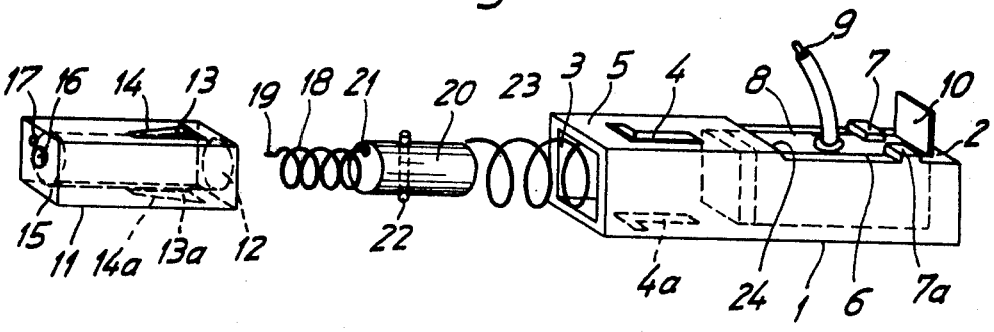
FIG. 1 is an exploded view of a piezoelectric igniter according to the invention.

The piezoelectric igniter shown in Figures comprises a housing 1 made of a plastics material and having a square cross-sectional form. Said housing is closed at one end by a bottom 2. L-shaped recesses 4 and 4a are provided at two opposite side surfaces of the plastics material housing in the frontal aperture 3 thereof, the long limbs of these recesses extending in the longitudinal direction of the plastics material housing 1, and the short limbs are branching transversely and counterclockwise from said long limbs when viewed from the frontal aperture 3.

The first side wall 5 of the housing, which extends between the second and third side walls being provided with the L-shaped recesses, has in the region of the bottom 2 a lateral aperture 6, which extends approximately over half the length of the housing 1. Near the bottom end of said lateral aperture two holding claws 7 and **7*a*** are provided and protrude from opposite side walls toward one another. Said holding claws are integral with the adjoining side walls.

A piezoelectric transducer 8, which has a length somewhat longer than the length of the lateral aperture 6, is inserted through the aperture 6 in the lower region of the housing 1. Said piezoelectric transducer is composed of two piezoelectric crystals between which an electrode having an extension 9 is arranged. The extension protrudes to the aperture 6 and forms a high-voltage lead.

An elastic sheet metal part 10, which is disposed between the bottom 2 of the housing 1 on the one hand and the piezoelectric transducer 8 on the other hand, serves as a mass-electrode for the adjacent piezoelectric crystal, whereas the other piezoelectric crystal may be grounded via a connecting lead (not shown).

The piezoelectric igniter further comprises an actuating cap 11, which has a square cross-section and is dimensioned such that it fits into the interior of the housing 1, leaving only a small clearance. Said actuating cap comprises a cylindrical blind hole 12 and, at two of its opposite side surfaces an aperture 13 and **13*a*, respectively, each aperture being provided with a slant cam surface 14 and 14*a*, respectively. Said apertures extend from the outside of said side walls to the cylindrical blind hole 12.**

The actuating cap 11 is closed at its one hand by a head plate 15, which has a central aperture 16, into which a push-button may be pressed for securely holding it. Furthermore, a small bore 17 is provided eccentrically from the central aperture 16 for receiving one end of a spring, as will be explained below.

A helical spring 18, having co-axially extending ends 19, is fitted into the cylindrical blind hole 12 and forms an energy storing spring. One of its ends is inserted in the small bore 17 in the head plate of the actuating cap 11.

The igniter furthermore comprises a hammer 20, which likewise fits into the cylindrical blind hole 12 and which has at its front side adjacent the helical spring 18 an eccentric bore 21, into which the other end 19 of the helical spring 18 engages. The hammer 20 is provided with a transverse bore, through which a locking pin 22 is inserted, which projects beyond the surface of said hammer on both sides of the same, and which has a length corresponding approximately to the width of the housing 1.

A return spring 23 is placed between the piezoelectric transducer 8 on the one hand and the open end edge of actuating cap 11 on the other hand. The internal diameter of said return spring is somewhat larger than the external diameter of the hammer 20.

Figure 2:
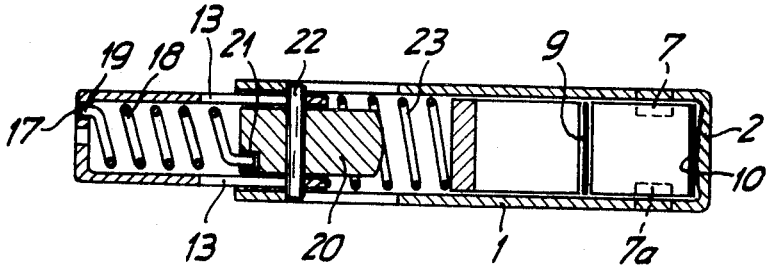
FIG. 2 is a longitudinal sectional view trough the assembled piezoelectric igniter according to FIG. 1.

FIG. 2 more clearly shows the assembly of the individual parts. First, the piezoelectric transducer 8 is inserted at the lateral aperture 6 into the housing 1 at a place between the holding claws 7 and the upper edge 24 of the lateral aperture 6. When the transducer has been pressed into the interior of the housing to such an extent that its bottom region has papssed the holding claws 7, 7a and contacts the sheet metal part 10, a pressure is exerted on said transducer to bring the upper part of the same under the edge 24 into the housing. Thereafter, the return spring 23 is placed into the housing 1 such that it rests on the piezoelectric transducer 8. The helical spring 18 is introduced into the interior of the actuating cap 11 until the end 19 of said spring engages into the small bore 17 of the actuating cap. Subsequently, the hammer 20 is introduced into the interior of the actuating cap 11 in such a position that the other end 19 of the helical spring engages the eccentric bore 21 in the hammer. The actuating cap with the structural parts contained therein is then brought into the interior of the housing, and the locking pin 22 is pressed through one of the L-shaped recesses 4, 4a and through the aperture 13 in the actuating cap through the transverse bore in the hammer 20, until said locking pin is placed symmetrically to the hammer 20.

During the assembly it is necessary to ensure that the hammer 20 has a torsional bias in the assembled condition of the piezoelectric igniter. This can be achieved for example by providing a blind hole in the hammer, which blind hole extends at right angles with respect to the transverse bore for the locking pin 22, and that the actuating cap comprises on one side surface an aperture through which a pin may be placed in order to maintain the hammer under a torsional bias when assembling the same. Once assembled, the pin is removed. However, the torsional bias may also be achieved by any other known manner, for instance by bringing one end 19 of the helical spring 18 into engagement with the corresponding bore 17 by means of a tool which is inserted through the central aperture 16.

Figure 3:
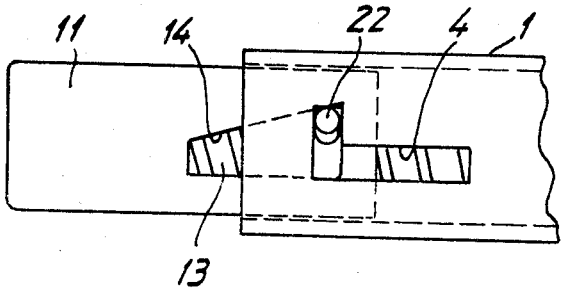
FIG. 3 is a partial side view of the piezoelectric igniter, which shows the L-shaped cut-out and the aperture co-operating therewith and having a slant cam surface.

The mode of operation of the piezoelectric igniter shown in FIGS. 1 and 2 will be explained with reference to FIG. 3. In FIG. 3, the actuating cap 11 is in its rest position. If the actuating cap is pressed down, corresponding to a movement from left to right in FIG. 3, the locking pin 22 is moved downwards by the action of the slant cam surface 14, until the locking pin slides over the corner of the L-shaped recess 4 and thus releases the hammer 20, which accordingly is accelerated by the action of the helical spring 18 and finally impinges on the piezoelectric transducer 8. As a result, a high-voltage pulse is generated between the extension 9 and the mass-electrode 10.

When the actuating cap is released, the return spring 23 brings the actuating cap back into its rest position, which is shown in FIG. 2.

It has been found that a housing made of plastics material leads to a higher energy of the electrical pulses in comparison to a metal housing and that the lifetime of the locking device, which is formed by L-shaped recesses **4, 4*a* and the locking pin 22** is increased, too.

We claim:

1. A piezoelectric igniter mechanism intended particularly for lighters, including a housing of oblong configuration accomodating a piezoelectric transducer at one end, an actuating hammer and an energy storing spring therefor at the other end, a pin transverse to said hammer extending from within said housing; a pair of oppositely placed L-shaped guide slots, each having a lateral portion and an axially extending portion in opposite walls of said housing, said slots engaging said pin, an actuating cap made of plastics material and slidably positioned over said housing having a pair of oppositely placed triangularly-shaped cutouts engaging said pin whereby, upon axial movement of said cap, said spring is compressed and said pin is constrained to move along the lateral portion of said guide slots and, upon reaching said axially extending portion, said hammer is freed to impinge upon said transducer by the energy released from said spring, said housing being of elastic material having resiliency in the axial direction of said hammer, thereby contributing to the effective action thereof, a resilient electrode plate arranged between the piezoelectric transducer and the bottom of the housing, the bottom of said housing being shaped convex to the inside of said housing, said housing having near its bottom and in its side wall an aperture adapted for inserting the piezoelectric transducer, and holding tabs for the transducer mounted on said housing adjacent the lower region of said aperture.

* * * * *